United States Patent [19]

Yanagishima et al.

[11] Patent Number: 4,514,599

[45] Date of Patent: Apr. 30, 1985

[54] SPEAKER FOR AUTOMOTIVE VEHICLE AUDIO SYSTEM HAVING A VEHICLE PANEL SERVING AS SOUND-AMPLIFYING MEDIUM

[75] Inventors: Takayuki Yanagishima; Junichi Kasai, both of Yokosuka, Japan

[73] Assignee: Nissan Motor Company, Limited, Yokohama, Japan

[21] Appl. No.: 582,143

[22] Filed: Feb. 24, 1984

Related U.S. Application Data

[63] Continuation of Ser. No. 329,875, Dec. 11, 1981, abandoned.

[30] Foreign Application Priority Data

| | | | |
|---|---|---|---|
| Dec. 19, 1980 | [JP] | Japan | 55-180203 |
| Apr. 18, 1981 | [JP] | Japan | 56-59006 |
| Apr. 18, 1981 | [JP] | Japan | 56-56390[U] |
| Apr. 18, 1981 | [JP] | Japan | 56-56391[U] |
| Apr. 23, 1981 | [JP] | Japan | 56-58806[U] |
| Sep. 25, 1981 | [JP] | Japan | 56-142189[U] |
| Sep. 25, 1981 | [JP] | Japan | 56-142190[U] |

[51] Int. Cl.[3] ..... H04R 9/00

[52] U.S. Cl. ..... 179/181 W; 179/86; 179/146 E

[58] Field of Search ..... 381/86; 179/181 W, 146 R, 179/146 E, 115.5 ES; 181/150, 161

[56] References Cited

U.S. PATENT DOCUMENTS

| | | | |
|---|---|---|---|
| 2,761,913 | 9/1956 | Manley | 179/115.5 H |
| 3,268,672 | 8/1966 | Roesel, Jr. et al. | 179/115.5 R |
| 3,430,007 | 2/1969 | Thielen | 179/181 W |
| 3,449,531 | 6/1969 | Ashworth | 179/181 W |
| 3,567,870 | 3/1971 | Rivera | 179/181 W |
| 3,861,495 | 1/1975 | Pearson | 181/163 |
| 3,993,345 | 11/1976 | Croup | 181/150 |

FOREIGN PATENT DOCUMENTS

| | | | |
|---|---|---|---|
| 1480768 | 4/1967 | France . | |
| 2304238 | 10/1976 | France . | |
| 56-13896 | 2/1981 | Japan | 179/181 W |
| 56-157199 | 12/1981 | Japan | 179/181 W |
| 2020509 | 11/1979 | United Kingdom . | |
| 2027316A | 2/1980 | United Kingdom . | |

*Primary Examiner*—Stafford D. Schreyer
*Assistant Examiner*—James L. Dwyer
*Attorney, Agent, or Firm*—Lane, Aitken & Kananen

[57] ABSTRACT

A speaker for use in an automotive vehicle audio system has a vehicle panel oscillating to produce audio frequency sounds. The vehicle panel is driven by a driver of the speaker at a frequency and amplitude corresponding to frequency and amplitude of an audio signal. Such a speaker is especially adapted to reproduce relatively low-frequency sounds.

18 Claims, 37 Drawing Figures

SPEAKER FOR AUTOMOTIVE VEHICLE AUDIO SYSTEM HAVING A VEHICLE PANEL SERVING AS SOUND-AMPLIFYING MEDIUM

This application is a continuation of application Ser. No. 329,875, filed Dec. 11, 1981, now abandoned.

BACKGROUND OF THE INVENTION

The present invention relates generally to a speaker for an automotive vehicle audio system, adapted to produce audio sound, particularly relatively low-frequency sounds. More specifically, the invention relates to a speaker using a vehicle panel as a replacement for the speaker cone of a cone-type speaker.

Generally, speakers for an automotive vehicle audio system are provided at various locations in the vehicle compartment. Conventionally, cone-type speakers are used for the vehicle audio system for producing audio sound in a frequency range suitable for clearly reproducing audio sound. However, since space in the vehicle compartment available for the speakers is seriously limited, the size of the cone-type speakers to be facilitated in the vehicle compartment must be limited. On the other hand, for clearly producing substantially low-frequency sounds such as sounds at frequencies less than 500 Hz, the speaker diameter must be approximately 20 cm. Such a large speaker cannot be installed in the vehicle compartment without significantly reducing the space in the vehicle compartment. Particularly, in an audio system having recessed speakers disposed between inner and outer vehicle panels or installed below the rear parcel shelf, the size of the speaker which can be used is strictly limited.

Consequently, for the standard passenger car, a 5-to-10-cm-diameter speaker is used. This degrades the audio sound quality being produced, particularly with respect to relatively low-frequency sounds.

SUMMARY OF THE INVENTION

Therefore, it is an object of the invention to provide a speaker for an automotive vehicle audio system, which is capable of producing substantially low-frequency sounds but is compact enough to be installed in the automotive vehicle.

Another and more specific object of the present invention is to provide a speaker using a vehicle panel as the oscillating and sound producing medium which is driven by an oscillating driver responsive to the audio system signal.

To accomplish the above-mentioned and other objects, a speaker, according to the present invention, includes a vehicle panel serving as the sound-producing medium. The vehicle panel as the sound-producing medium is driven by an oscillating driver to oscillate at a frequency and magnitude corresponding to the frequency and amplitude of the audio signal. The driver is responsive to the audio signal to be energized and deenergized corresponding to the frequency and amplitude of the audio signal.

BRIEF DESCRIPTION OF THE DRAWINGS

The present invention will be understood more fully from the detailed description given hereinbelow and from the accompanying drawings of the preferred embodiment of the present invention, which, however, should not be taken as limitative of the invention but are for elucidation and explanation only.

In the drawings.

DESCRIPTION OF THE PREFERRED EMBODIMENT

Figure 1:
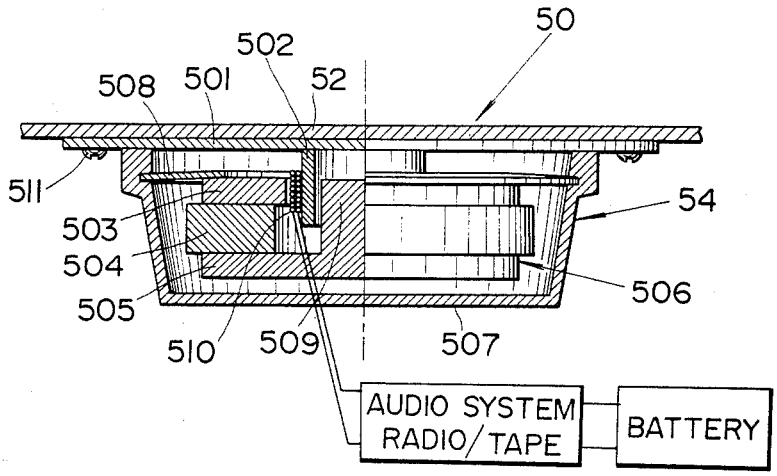
FIG. 1 is a cross-section of the first embodiment of a panel speaker according to the present invention.

Referring now to the drawings, particularly to FIG. 1, there is illustrated the first embodiment of a panel speaker for an automotive vehicle audio system, according to the present invention. The panel speaker 50 generally utilizes a vehicle panel 52, which comprises part of a vehicle body, as as oscillation member instead of a speaker cone. The vehicle panel 52 is oscillated by a driver 54 which is attached to the vehicle panel 52 and drives the latter to produce audio sound vibrations. In order to adapt the vehicle panel 52 to be utilized as a replacement for the speaker cone, the size, thickness and material of the vehicle panel is selected so that it may have a resonating frequency suitable for reproducing audio sound in response to signals fed from car-radio, car-stereo and/or other vehicle audio systems.

According to the first embodiment of the invention as illustrated in FIG. 1, the driver 54 comprises an oscillating plate 501 with a tubular extension 502 protruding from the central portion thereof, an annular yoke plate 503, annular magnet 504 and a pole member 505. The yoke plate 503, the magnet 504 and the pole member 505 comprise a driver assembly 506. The driver assembly 506 is suspended within a driver housing 507 from an annular resilient plate 508 so that is can move vertically with respect to the oscillating plate 501. The pole member 505 has a cylindrical projection 509 extending from the central portion thereof. The cylindrical projection 509 is inserted into the center of the annular extension 502 so that it may move along the longitudinal axis of the extension 502 according to the motion of the driver assembly 506. On the outer periphery of the annular extension 502 is wound a magnetic coil 510 which is connected to the vehicle audio system to receive audio signals therefrom. The magnetic coil 510 is energized and deenergized according to the audio signal to oscillate the oscillating plate 501 with respect to the driver assembly 506. The oscillating plate 501 is securely fixed onto the vehicle panel 52 with fastening members such as screws 511.

In the above-described construction, the magnetic coil 510 is energized and deenergized according to the frequency and amplitude of the audio signal to cause relative motion of the driver assembly 506 and the oscillating plate 501 at a frequency and magnitude corresponding to the audio signal frequency. The oscillating plate 501 is thus oscillated at a frequency and magnitude corresponding to the sound represented by the audio signal. The oscillation of the oscillating plate 501 is transmitted to the vehicle panel 52 to oscillate the latter to reproduce audio sound.

Figure 2:
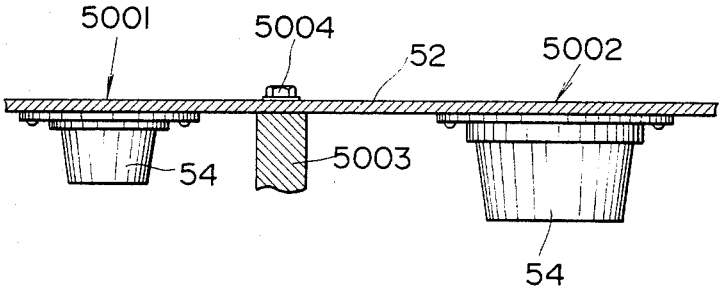
FIG. 2 is an illustration showing one example of the panel speaker arrangement.

FIGS. 2 to 6 show variations of speaker arrangements in the automotive vehicle audio system, in which the panel speaker according to the present invention is applied. FIG. 2 shows a typical arrangement of the speaker system of the automotive vehicle audio system, which speaker system includes speakers 5001 and 5002. The speaker 5001 is adapted to reproduce relatively high frequency sounds and the speaker 5002 is adapted to reproduce relatively low frequency sounds. Each speaker 5001 and 5002 comprises a vehicle panel 52 and a driver 54. In the embodiment shown, the vehicle panel 52 is a thin, flat plate which is oscillable in response to force provided by the driver 54. The vehicle panel 52 is supported on a vehicle body (not shown) by a support member 5003, to which the vehicle panel 52 is secured by a screw 5004.

Although FIG. 2 shows a specific arrangement of the speaker system of the vehicle audio system, it may be possible to arrange the speakers i various combinations or constructions. FIGS. 3 to 6 show modifications of the arrangement of FIG. 2.

Figure 3:
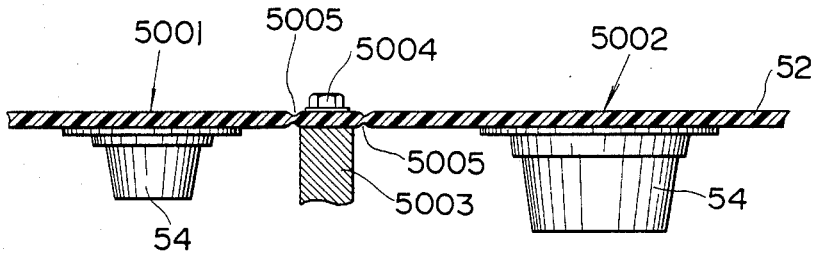
FIG. 3 is an illustration similar to FIG. 2 and showing modification of the speaker arrangement of FIG. 2.
Figure 4:
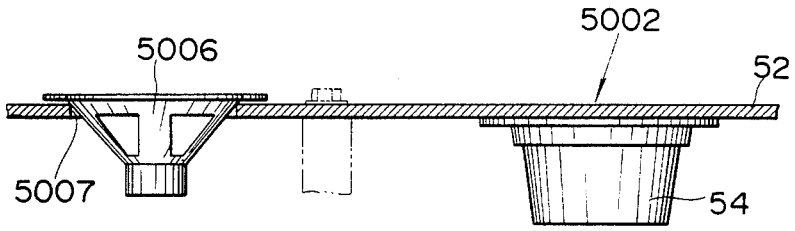
FIG. 4 is an illustration similar to FIG. 2 and showing a further modification of the speaker arrangement of FIG. 2.

In FIG. 3, grooves 5005 are formed in the panel 52 near the support member 5003. The grooves 5005 improve the flexibility of the vehicle panel 52 and isolate the sections separated by the support member 5003 from oscillations due to the speakers of other sections. In this construction, interference in neighboring sections is effectively prevented and thus each section can be driven to oscillate different frequencies independently. FIG. 4 shows another modification in which a cone speaker 5006 is utilized to reproduce relatively high frequency sounds. The cone speaker 5006 is mounted on the vehicle panel 52 which receives the cone speaker in a through opening 5007. As illustrated in phantom line in FIG. 4, it is possible to isolate the section of the vehicle panel supporting the cone speaker from oscillations due to the driver 54 of the other section.

Figure 5:
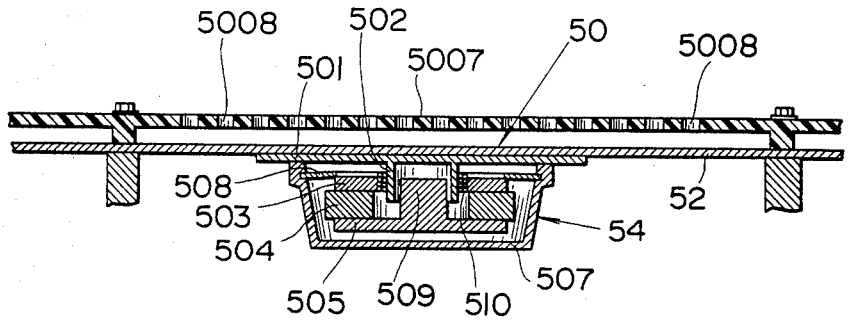
FIG. 5 is a cross-section of the second example of the speaker arrangement according to the present invention.
Figure 6:
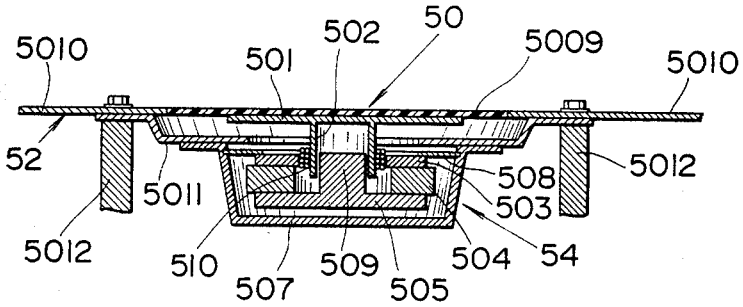
FIG. 6 is a cross-section of the third example of the speaker arrangement.

As shown in FIG. 5, a grille 5007 is provided in front of the vehicle panel 52 in order to prevent the vehicle panel from being contacted by the passenger, which might possibly degrade the audio sound. The grille 5007 is formed with a plurality of holes 5008 which permit the audio sound produced by the vehicle panel 52 to pass therethrough. The holes 5008 help the speaker to reproduce clear audio sound. FIG. 6 shows a further modification of the speaker arrangement which has a modified structure. In this modification, the vehicle panel 52 consists of two different materials. The piece 5009 opposing the driver 54 is made of a material having better oscillation characteristics than that of the other piece 5010 which is more rigid than the former. In this modification, the driver housing 507 is suspended on the vehicle body from annular brackets 5011 and support members 5012.

Figure 7:
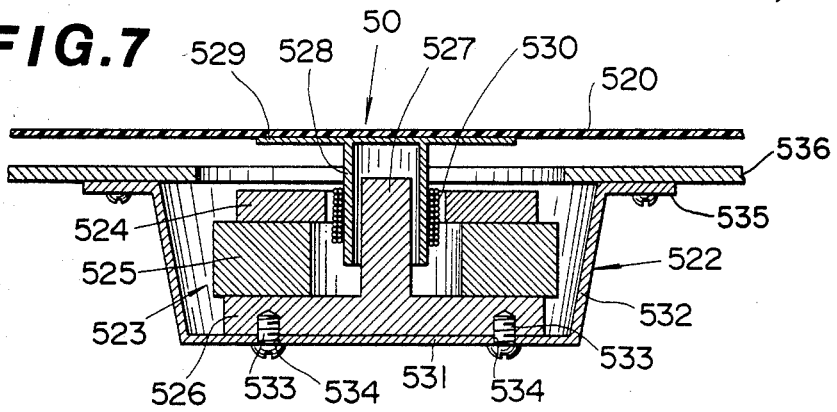
FIG. 7 is a cross-section of the second embodiment of the panel speaker according to the present invention.

FIG. 7 shows the second embodiment of the panel speaker according to the present invention. The speaker 50 comprises a vehicle panel 520 serving as replacement for the speaker cone and a driver 522 for inducing oscillation in the vehicle panel. The vehicle panel 520 is made of a synthetic resin suitable for reproducing audio sound vibrations. Similar to the foregoing first embodiment, the driver 522 includes a driver assembly 523 comprising a yoke plate 524, a magnet 525 and a pole member 526. The pole member 526 has a cylindrical projection 527 which is inserted into the central aperture of a tubular extension 528 protruding from an oscillating plate 529. The extension 528 is encircled by a magnetic coil 530 which energizes and deenergizes the driver assembly 523 in response to an audio signal fed from the audio system, such as a car-radio, car-stereo and so forth. The yoke plate 524, the magnet 525 and the pole member 526 are assembled into the driver assembly and fixed onto the bottom 531 of a driver housing 532 with screws 533 which pass through openings 534 formed in the bottom 531 and engage with the pole member 526. The driver housing 532 has a flange portion 535 by which it is secured to a support plate 536 which is another vehicle panel comprising part of the vehicle body assembly. In this construction, the oscillating plate 529 with the tubular extension 528 moves along the axis of the extension 528 in response to the energizing and deenergizing of the driver assembly. The oscillation of the oscillating plate 529 is transmitted to the vehicle panel 520 to cause the latter to oscillate to produce audio sound.

According to the present embodiment, since the oscillation of the vehicle panel 520 results from the motion of the oscillating plate 529 while the driver assembly 523 is held stationary, transmission of the oscillation can be effectively performed in response to frequency and magnitude of the audio signal fed from the audio system.

Figure 8:
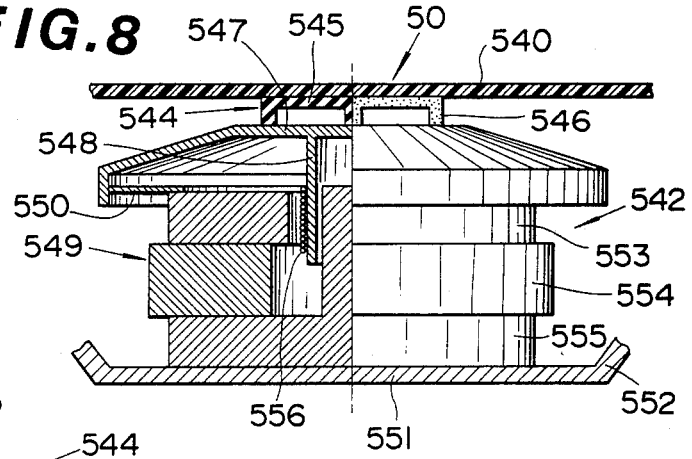
FIG. 8 is a cross-section of the third embodiment of the panel speaker of the invention.
Figure 9:
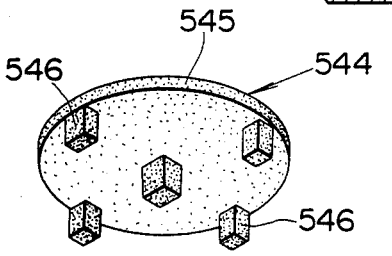
FIG. 9 is a perspective view of an elastic member used in the panel speaker of FIG. 8.

FIGS. 8 and 9 illustrate the third embodiment of the panel speaker construction, in which panel speaker 50 comprises the vehicle panel 540 and the driver 542, similar to the foregoing embodiments. An elastic member 544 having disc-shaped main body 545 and a plurality of legs 546 is interposed between the vehicle panel 540 which is to be driven to oscillate by the driver 542. The driver 542 comprises a dish-shaped oscillating plate 547 having a central tubular extension 548. The oscillating plate 547 is supported above the driver assembly 549 by an annular resilient plate 550. The driver assembly 549 is fixed to the bottom 551 of a driver housing 552 which is suspended from the vehicle body (not shown). Similar to the foregoing embodiments, the driver assembly 549 comprises a yoke plate 553, a magnet 554 and a pole member 555. The magnetic coil 556 is wound around the periphery of the extension 548 to drive the driver assembly 549 in response to the audio signal fed from the audio system.

In this embodiment, the elastic member 544 serves to transmit oscillation produced by the driver to the vehicle panel 40 with characteristics accurately corresponding to the frequency and magnitude of the audio signal.

Figure 10:
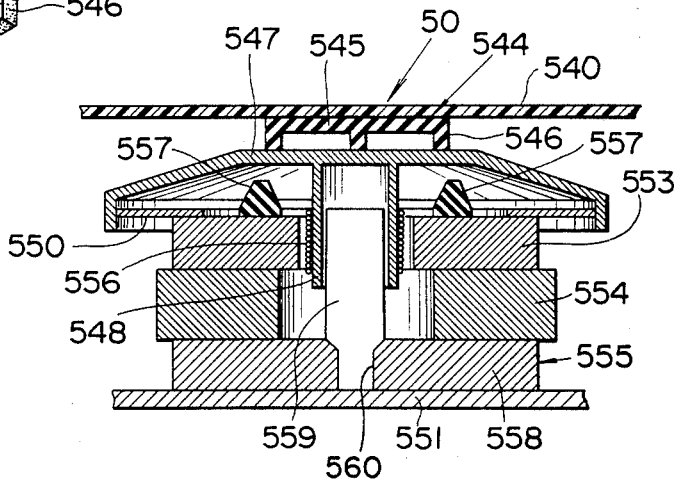
FIG. 10 is a cross-section showing a modification of the third embodiment of the panel speaker of FIG. 8.

FIG. 10 shows a modification of the third embodiment of the panel speaker of FIG. 8. In this modification, stoppers 557 are secured on the yoke plate 553 so that they may limit deformation of the annular resilient plate 550 toward the oscillating plate 547. As seen in FIG. 10, the pole member 555 comprises a disc-shaped section 558 and a cylindrical section 559 formed separately. The disc-shaped section 558 is formed with a central opening 560 which receives an end of the cylindrical section 559.

Figure 11:
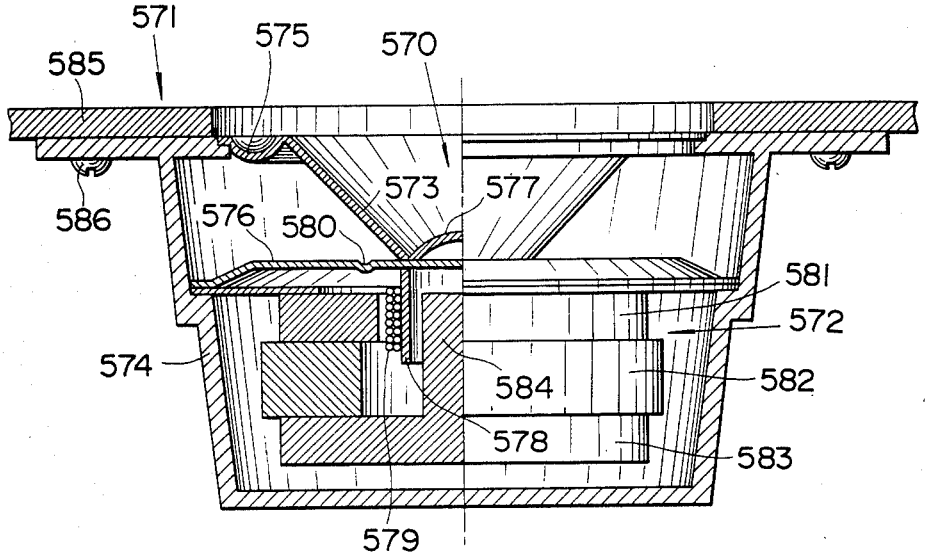
FIG. 11 is a cross-section of the fourth embodiment of the panel speaker of the present invention, in which the panel speaker is combined with a cone speaker for constituting a two-way speaker.
Figure 12:
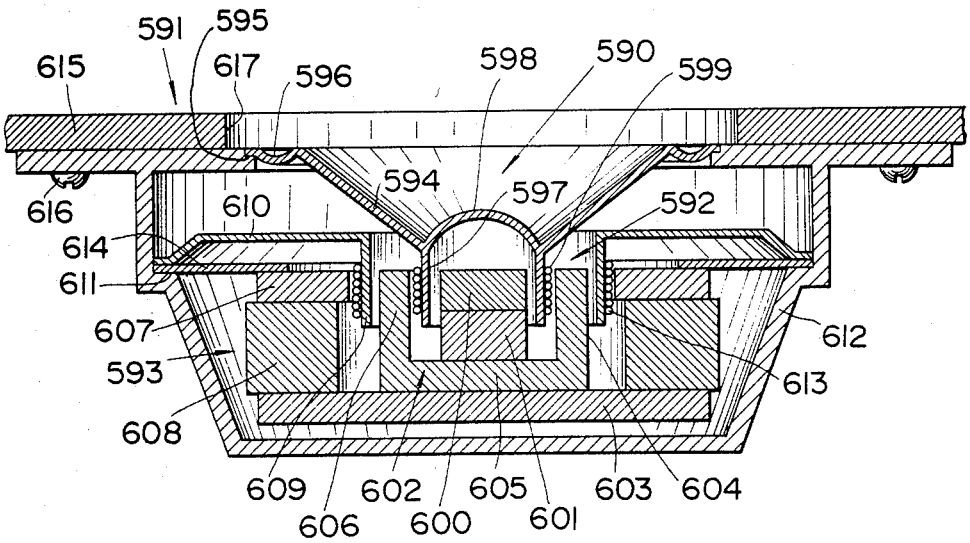
FIG. 12 is a cross-section of a modification of the speaker of FIG. 11.
Figure 13:
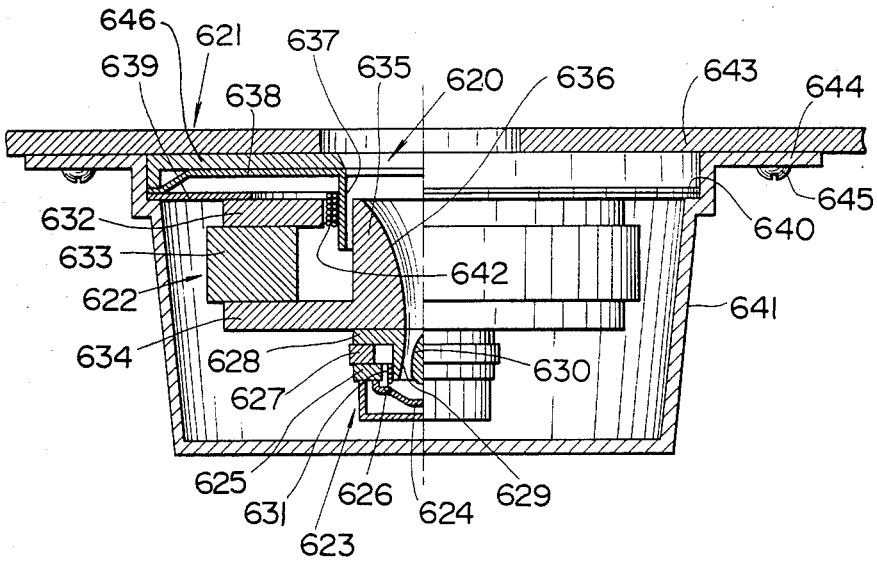
FIG. 13 is a cross-section of a further modification of the speaker of FIG. 11.

It should be appreciated that, although the foregoing embodiments illustrate various constructions of the panel speaker of the invention, in which a speaker cone of a cone speaker is replaced by a vehicle panel, the invention may include a speaker having both a speaker cone and a vehicle panel as sound-producing means. A speaker which functions both as a cone speaker and as a panel speaker may be utilized for a two-way speaker system, in which each speaker has sections, respectively, reproducing relatively high frequency sounds and relatively low frequency sounds. FIGS. 11 to 13 show, respectively, modifications of the foregoing embodiments.

FIG. 11 illustrates a modification acting both as a cone speaker and a panel speaker. In this embodiment, the cone speaker 570 and the panel speaker 571 use a common driver 572. The cone speaker 570 includes a speaker cone 573 of hollow conical configuration. The speaker cone 573 is fixed to the upper inner edge of the driver housing 574 via an annular edge member 575 and to an oscillating plate 576 via a center cap 577. The oscillating plate 576 is secured to the driver housing 574 at its circumferential edge. The oscillating plate 576 is provided with a tubular extension 578 at the central portion thereof, which is encircled by a magnetic coil 579. Also, the oscillating plate 576 is formed with a circular groove 580 around the center cap 577. The driver 572 is oscillably suspended within the driver housing 574 so that it may drive the oscillating plate 576 to oscillate in response to the energizing and deenergizing of the magnetic coil 579. The driver 572 comprises the yoke plate 581, the magnet 582 and the pole member 583 having a cylindrical projection 584 inserted into the center of the tubular extension 578.

The driver housing 574 is fixed to the vehicle panel 585 with screws 586. Together with the driver 572, the vehicle panel 585 comprises a panel speaker 571. Since the driver housing 574 is secured to the vehicle panel 585, relatively low frequency oscillations imparted to the oscillating plate 576 by the driver 572 will be transmitted to the vehicle panel via the driver housing. On the other hand, relatively high frequency oscillations of the oscillating plate 576 will be transmitted to the speaker cone 573.

In this case, since the oscillating plate 576 is separated into a circular center section and an annular section by the groove 580, the oscillating frequencies of the two sections and can be different.

FIG. 12 shows a modification of the combined cone and panel speakers of FIG. 11. In this modification, the cone speaker 590 and the panel speaker 591 are driven by independent drivers 592 and 593. The speaker cone 594 is fixed to the upper inner edge of the driver housing 595 via the annular edge member 596 and has a vertically extending tubular portion 597 extending from the periphery of the center cap 598. The tubular portion 597 is encircled by a magnetic coil 599. A yoke plate 600 and a magnet 601 are inserted into the tubular portion 597. The pole member 602 comprises a disc-shaped member 603 and a cup-shaped member 604 which has a bottom section 605 fixed to the disc-shaped member 603. A wall 606 of the cup-shaped member 604 sorrounds the tubular portion 597 with a small clearance therebetween. The yoke plate 600, the magnet 601 and the pole member 602 constitute a driver 592 for driving the speaker cone 594. The driver 592 is energized and deenergized by the audio signal produced by the vehicle audio system and applied to the magnetic coil 599.

The wall 606 of the pole member 602 is surrounded by another yoke plate 607 and another magnet 608. The wall 606, the yoke plate 607 and the magnet 608 constitute another driver 593. A vertically bent tubular end section 609 of the oscillating plate 610 which is, in turn, secured to a step 611 in the driver housing 612, is interposed between the wall 606 of the pole member 602 and the assembly of the yoke plate 607 and the magnet 608. The magnetic coil 613 is wound onto the periphery of the tubular end section 609 of the oscillating plate 610 so that it may drive the oscillating plate 610 in response to the audio signal.

The yoke plate 607 is secured to the inner periphery of an annular resilient plate 614 which is, in turn, secured to the step 611 of the driver housing 612 together with the oscillating plate 610. Thus, drivers 592 and 593 are suspended within the driver housing 612 from the resilient plate 614. The driver housing 612 oscillates in response to oscillation of the oscillating plate 610 to transmit oscillation to the vehicle panel 615 to which the driver housing is fixed with screws 616. The vehicle panel 615 is thus driven to reproduce audio sound.

The vehicle plate 615 has an opening 617 for permitting audio sound reproduced by the cone speaker to radiate therethrough. As can be easily appreciated, the cone speaker of this embodiment is adapted to reproduce relatively high frequency sounds and the panel speaker is adapted to reproduce relatively low frequency sounds.

Referring to FIG. 13, there is illustrated another embodiment of a speaker which combines a cone speaker 620 and a panel speaker 621. The cone speaker 620 is placed behind the driver 622 of the panel speaker 621. The cone speaker 620 comprises generally the driver 623 and the speaker cone 624. The speaker cone 624 is suspended from the annular yoke plate 625 of the driver 623 via a damper 626. The driver 623 further includes the magnet 627 and the pole member 628 which is formed with a central opening 629 serving as part of a speaker horn and receiving therein a horn equalizer 630. The magnetic coil 631 is inserted in a space between the pole member and the magnet to drive the driver 623.

The driver 622 of the panel speaker 621 comprises the yoke plate 632, the magnet 633 and the pole member 634. The pole member 634 has a cylindrical portion 635 including an outwardly-directed, horn-shaped central opening 636 which serves as a speaker horn for the cone speaker 620. The upper portion of the cylindrical portion 635 is inserted into a tubular extension 637 of the oscillating plate 638. The yoke plate 632 is secured to the inner edge of the resilient plate 639 which is secured to the step 640 of the driver housing 641. On the other hand, the pole member 628 of the driver 623 is fixed on the pole member 634. Thus, the drivers 622 and 623 are oscillably suspended in the driver housing 641 from the resilient plate 639.

The oscillating plate 638 is also secured to the step 640 of the driver housing 641 to transmit oscillation thereto. The magnetic coil 642 is wound around the outer periphery of the tubular extension 637 to energize and deenergize the driver 622 to reproduce audio sound via oscillation of the vehicle panel 643 to which the flange 644 of the driver housing 641 is secured with screws 645. The oscillating plate 638 is further secured to a substantially annular disc-shaped plate 646 which is, in turn, fixed to the vehicle panel 643 in order to effectively transmit the oscillation of the oscillating plate 638 to the vehicle panel.

Figure 14:
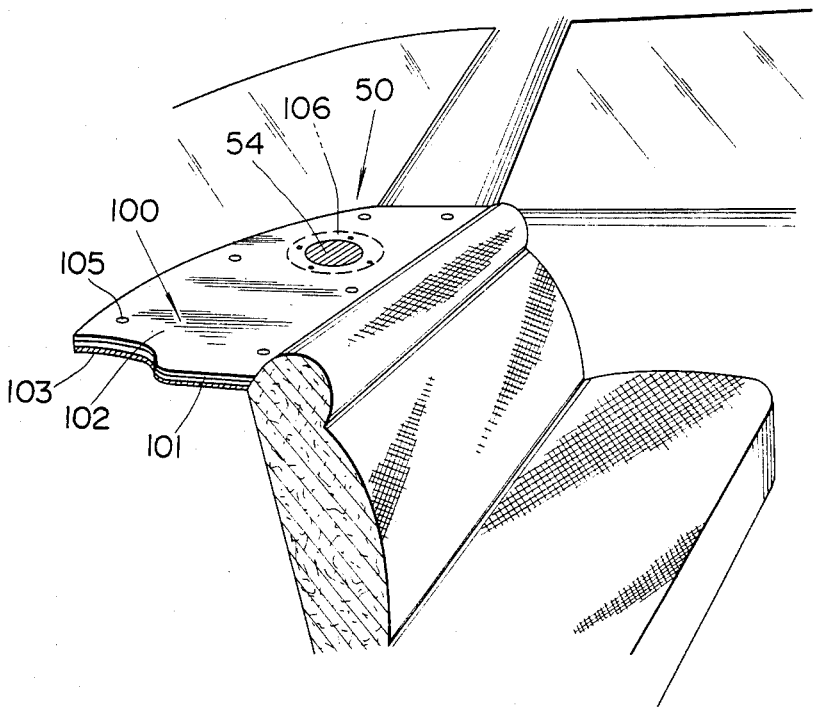
FIG. 14 is a partial perspective view of the rear part of the automotive vehicle, which is provided the panel speaker of the present invention at the rear parcel shelf.

FIGS. 14 to 30 show variations of speaker arrangements provided in a rear parcel shelf of the automotive vehicle. As shown in FIG. 14, the rear parcel shelf 100 comprises a core 101 such as hardboard, a plastic plate, a metal sheet or the like, and a lining 102, such as carpet and the like. The parcel shelf 100 is fixed onto a rear parcel shelf inner panel 103 which constitutes part of vehicle body. Since the rear parcel shelf 100 is secured to vertical ribs 104 of the rear parcel shelf inner panel 103 with screws 105, the portion between the ribs 104 can be oscillated to produce sound. The portion of the parcel shelf 100 adapted for oscillating is hereafter referred to as the oscillating section 106.

The driver 54 is secured to the center of the oscillaing section 106 of the rear parcel shelf 100 and housed in the space below the rear parcel shelf. The oscillating section 106 and the driver 54 thus constitute the panel speaker 50.

Figure 15:
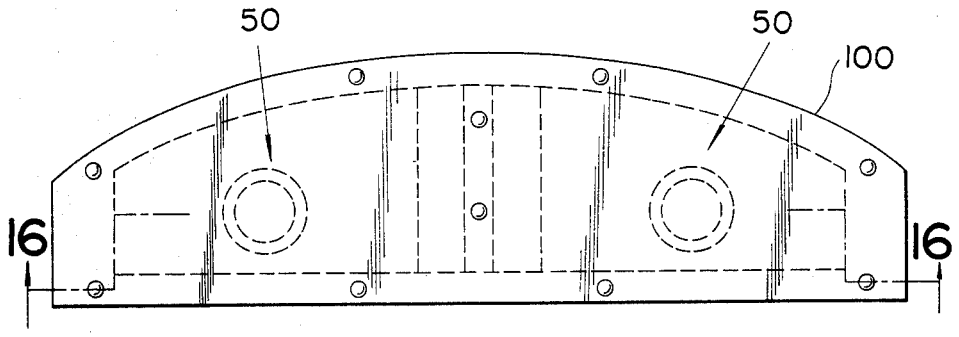
FIG. 15 is a plan view of a rear parcel shelf including panel speaker arrangement as one example.
Figure 16:
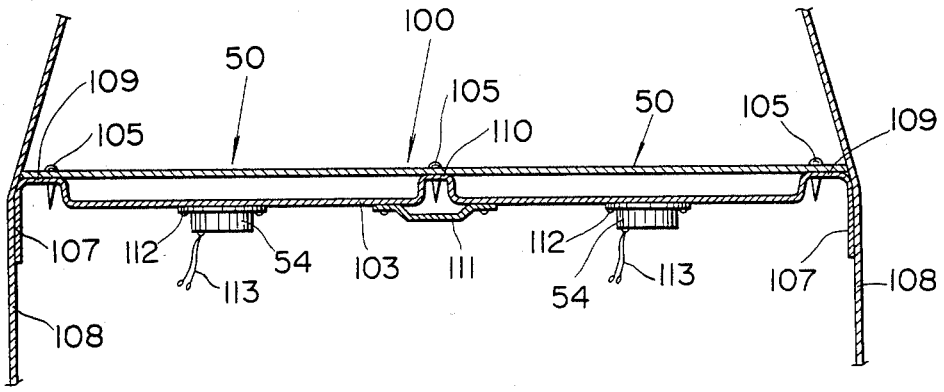
FIG. 16 is a transverse section of the rear parcel shelf of FIG. 15 taken along line 16—16 of FIG. 15.

FIGS. 15 and 16 show the first arrangement of the panel speaker system. As apparent from FIG. 16, the panel speaker 50 of this example consists of the rear parcel shelf inner panel 103 and the driver 54. The parcel shelf inner panel 103 has end sections 107 fixed to a vehicle body inner side panel 108. The parcel shelf inner panel 103 is further formed with a rib 109 extending along the entire circumference thereof and a rib 110 extending along the center line thereof. The parcel shelf inner panel 103 is supported along the central rib 110 by a rigid support member 111, the ends of which are secured to the vehicle body. The rear parcel shelf 100 rests on the ribs 109 and 110 and is secured thereto by a plurality of screws 105.

At the center of the oscillating sections 106 of the parcel shelf inner panel 103, a pair of drivers 54 are fixed to the lower surface thereof with screws 112. Each of the drivers 54 is electrically connected to the vehicle audio system, such as a car-radio, car-stereo and so forth, acting as a source of audio signals, via lines 113. Thus, the drivers 54 are energized and deenergized at a frequency and a magnitude corresponding to the audio signal in order to drive the parcel shelf inner panel 103 to oscillate. Due to oscillation of the parcel shelf inner panel, audible sound is created.

Figure 17:
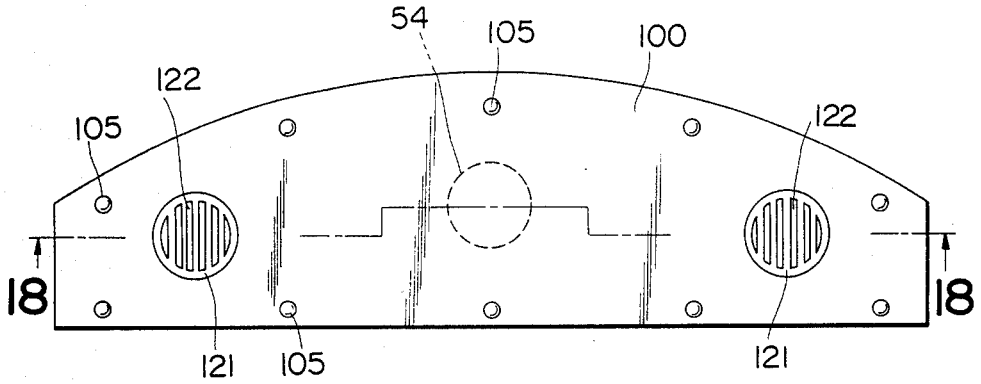
FIG. 17 is a plan view of the rear parcel shelf having another example of a speaker arrangement.
Figure 18:
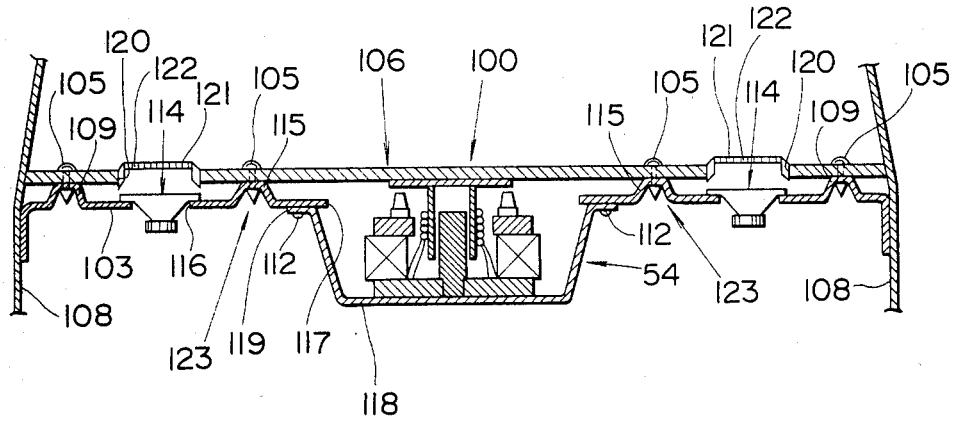
FIG. 18 is a transverse section of the speaker arrangement of FIG. 17 and taken along line 18—18 of FIG. 17.

FIGS. 17 and 18 show the second arrangement in which cone speakers 114 are used to produce relatively high frequency sounds, and the panel speaker 50 produces relatively low frequency sounds. Similar to the foregoing first arrangement, the parcel shelf inner panel 103 is secured to the vehicle body inner side panel 108 at both ends thereof. The parcel shelf inner panel 103 has a circumferentially extending rib 109 and a pair of transversely extending ribs 115 which define therebetween the oscillating section 106 of the rear parcel shelf 100. The parcel shelf inner panel 103 is further formed with through openings 116 and 117 in which the cone speakers 114 and the driver 54 of the panel speaker 50, which consists of the driver 54 and the oscillating section 106 of the rear parcel shelf, are installed. The driver 54 is supported by the driver housing 118 which is secured to the circumference of the opening 117 via a flange 119 thereof.

The rear parcel shelf 100 is secured to the ribs 109 and 115 with screws 105. The rear parcel shelf 100 is formed with through openings 120 at the portions opposing the cone speaker 114. Cone speaker covers 121 with a plurality of slots 122 are mounted over the openings 120 to permit the sound produced by the cone speaker to pass therethrough. The oscillating section 106 of the rear parcel shelf 100 is defined between the portions secured to the ribs 115, which will hereafter be referred to as the supporting sections 123. The supporting sections 123 serve to isolate the oscillating section 106 from vibratory interference due to the oscillation of other sections.

Preferably, an elastic member will be interposed between the rear parcel shelf 100 and the ribs 123 to absorb oscillations of respective sections in order to permit each section to be oscillated independently of other sections.

Figure 19:
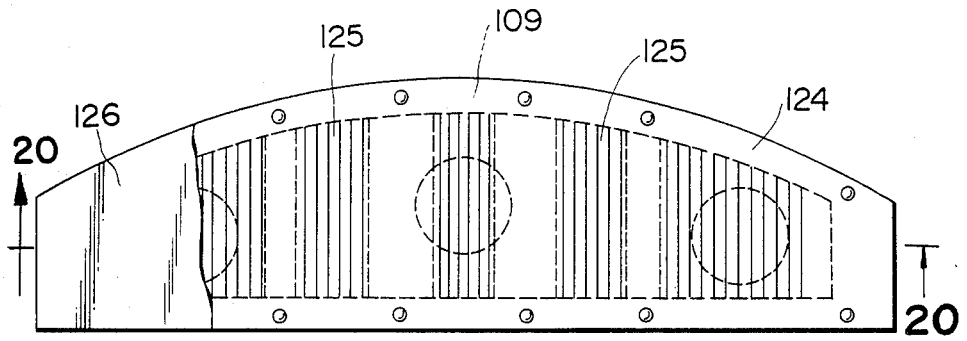
FIG. 19 is a plan view of the rear parcel shelf including a further example of the speaker arrangement.
Figure 20:
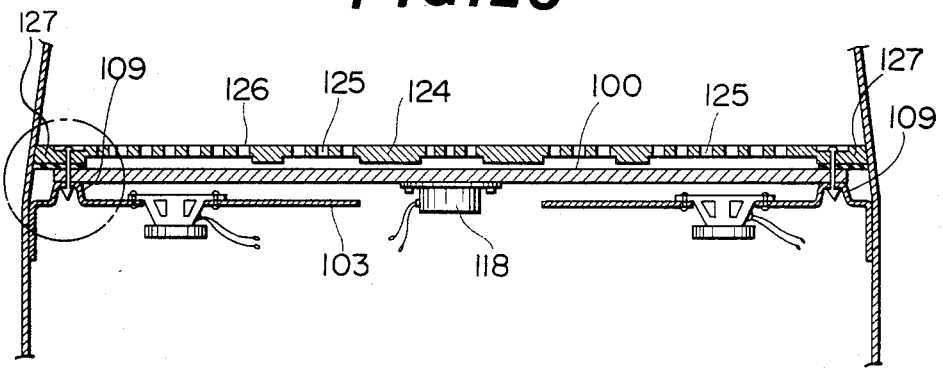
FIG. 20 is a transverse section of the speaker arrangement of FIG. 19 taken along line 20—20 of FIG. 19.
Figure 21:
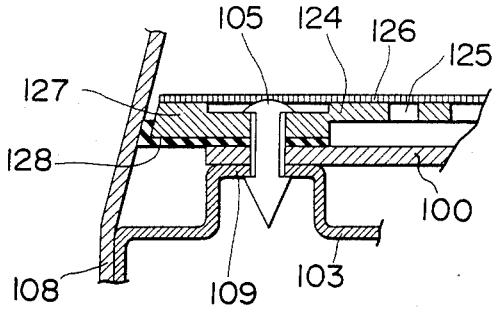
FIG. 21 is an enlarged partial section showing a portion encircled as 21 in FIG. 19.

As apparent from FIG. 18, the driver 54 is constructed as described with reference to FIG. 7. Therefore, further description therefor is not given here except with respect to the reference numerals included in FIG. 18. It should be, therefore, appreciated that each reference numeral used in the driver construction corresponds to the corresponding part in FIG. 7. FIGS. 19 to 21 illustrate the third arrangement which is similar to the second arrangement as set forth. In this embodiment, a grille 124 with a plurality of transversally extending slots 125 is mounted over the rear parcel shelf 100 in order that the rear parcel shelf 100 as a sound producing medium will not be exposed within the vehicle compartment. The top of the grille 124 is covered with a decorative lining 126 such as carpet or the like. As particularly shown in FIGS. 20 and 21, the grille 124 is fixed to the rib 109 of the parcel shelf inner panel 103 together with the rear parcel shelf 100 at the edge 127 thereof with the screws 105. An elastic member 128 is interposed between the lower surface of the edge 127 and the rear parcel shelf 100 so as to prevent the grille 124 from oscillating with the rear parcel shelf 100.

It will be appreciated that the driver housing 118 of the driver 54 is secured to the rear parcel shelf 100, in this embodiment. Although this is different from the foregoing second arrangement, the fitting of the driver housing 118 onto the rear parcel shelf 100 as the sound-producing medium will not effect the quality of the reproduced sound.

Figure 22:
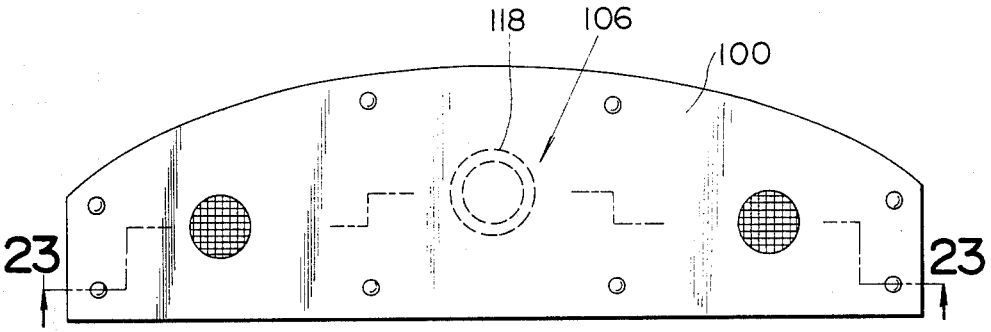
FIG. 22 is a plan view of the rear parcel shelf including a still further example of the speaker arrangement.
Figure 23:
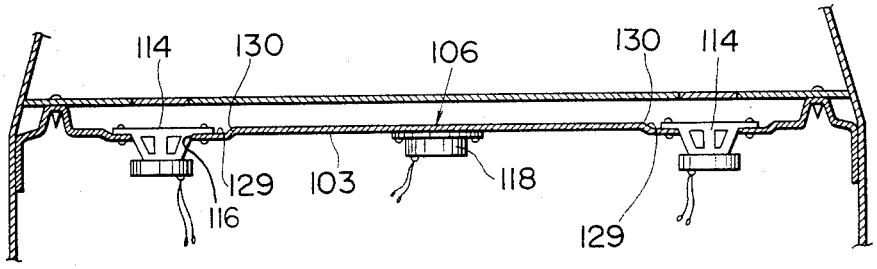
FIG. 23 is a transverse section of the speaker arrangement of FIG. 22 taken along line 23—23 of FIG. 22.

FIGS. 22 and 23 show a fourth arrangement similar to the second arrangement. The only difference between this embodiment and the second arrangement is that the parcel shelf inner panel 103 is utilized as a sound-producing medium in this embodiment. Therefore, the driver 54 with the driver housing 118 is fixed to the parcel shelf inner panel 103. On the other hand, the cone speakers 114 are respectively received in openings 116 formed in shallow depressions 129 of the inner panel 103. The slopes 130 of the depressions 129 serve as isolating means for preventing the oscillation of the parcel shelf inner panel 103 at the oscillating section 106 from being transmitted to the cone speakers 114.

Figure 24:
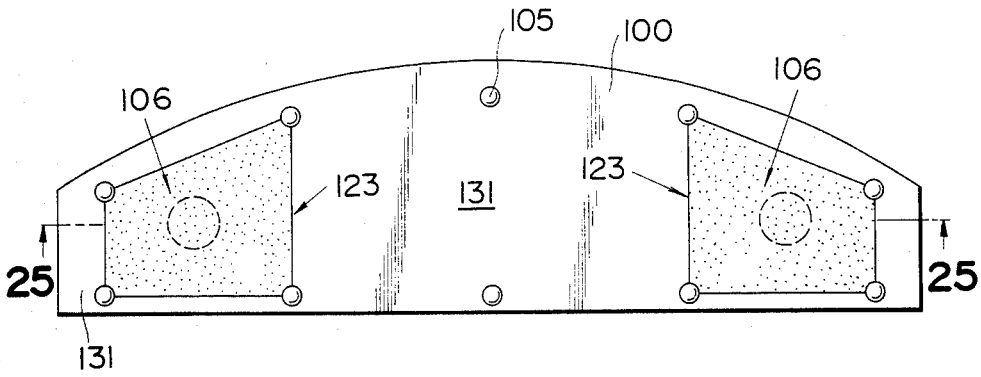
FIG. 24 is a plan view of the rear parcel shelf illustrating a still further example of the speaker arrangement.
Figure 25:
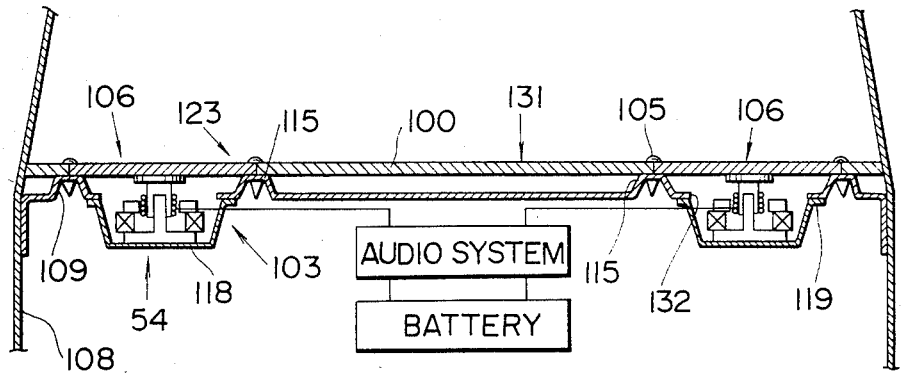
FIG. 25 is a transverse section of the speaker arrangement taken along line 25—25 of FIG. 24.

FIGS. 24 and 25 show the fifth arrangement which corresponds to the speaker construction generally illustrated with reference to FIG. 6. In this embodiment, the rear parcel shelf 100 includes a major section 131 and an oscillating section 106 which are made of different materials. The material of the oscillating section 106 is selected to have better oscillating characteristics for producing audio sound and to have a resonating frequency range which is suitable for producing the desired range of audio frequencies.

In the embodiment shown, the parcel shelf inner panel 103 is attached to the vehicle body inner side panel 108 at both ends thereof and has a circumferentially extending rib 109 and transversely-extending ribs 115. The oscillating sections 106 are respectively defined between the supporting sections 123 and the circumferentially supported sections. The parcel shelf inner panel 103 is formed with a pair of through openings 132 for receiving drivers 54, respectively opposing the oscillating sections 106 of the rear parcel shelf 100. The driver housings 118 are secured to the parcel shelf inner panel 103 via flanges 119. The driver 54 per se is of the same construction as described with reference to FIG. 7. Therefore, description of the structure or operation of the driver 54 will not be repeated.

In FIG. 25, the major section 131 and the oscillating section 106 are joined at the supporting section 123 with a common fastening screw 105.

Figure 26:
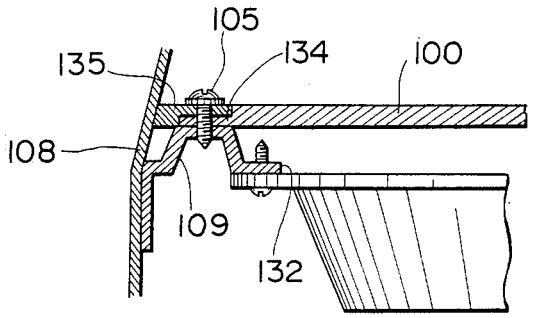
FIG. 26 is an enlarged partial section of the speaker arrangement of FIG. 25, in which is shown a modification of the arrangement of FIG. 25.
Figure 27:
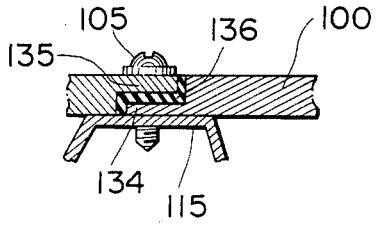
FIG. 27 is a further enlarged section showing further modification of the arrangement of FIG. 25.
Figure 28:
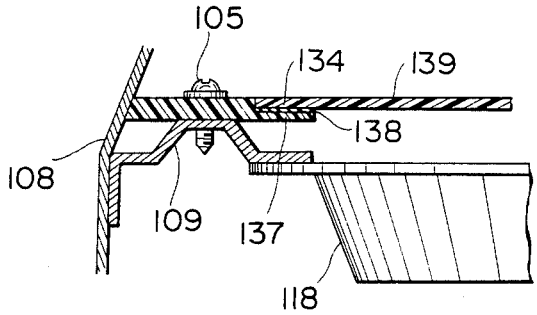
FIG. 28 is an enlarged section showing a still further modification of the arrangement of FIG. 25.

FIGS. 26 to 28 show respectively modifications of ways to join the major section 131 to the oscillating section 106. In FIG. 26, the circumferential section and the oscillating section 106 are respectively provided mating flanges 134 and 135 on the opposing edges thereof. The flanges 134 and 135 overlap and are secured to the rib 109 of the parcel shelf inner panel 103 with a common screw 105. In FIG. 27, an elastic oscillation isolating member 136 is inserted between the flanges 134 and 135 to isolate the oscillating section 106 from the major section. This may protect the oscillating section 106 from vibration which otherwise might cause noise in the audio sound. FIG. 28 shows another joining construction of the major section 131 and the oscillating section 106. In the construction shown, the major section 131 and the oscillating section 106 are made of the same material but of different thickness. The thickness of the major section 131 is selected in order to provide sufficient rigidity therefor and, in turn, the thickness of the oscillating section is adapted for oscillation by the driver 54 in order to produce audio sound of the frequency and magnitude corresponding to the frequency and amplitude of the audio signal. The major section 131 is secured to the rib 109 with a screw 105 and has a rest 137 around the opening 138 to define the oscillating section 106. The oscillable plate 139 constituting the oscillating section 106 is bonded to the rest 137.

Figure 29:
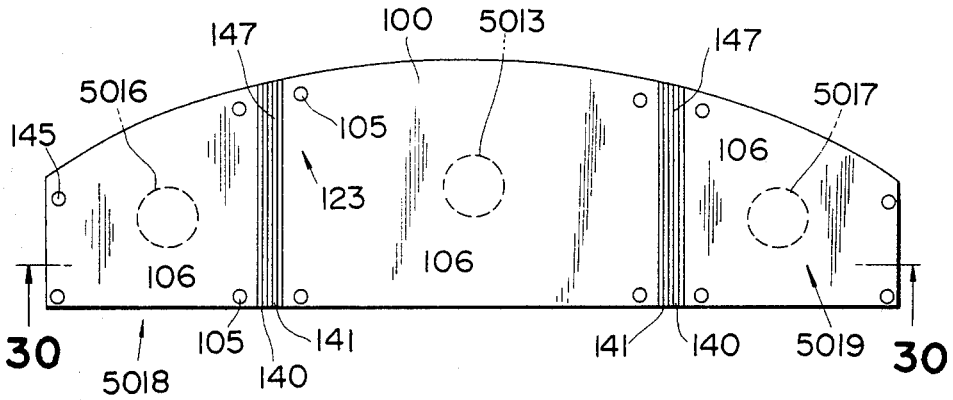
FIG. 29 is a plan view of the rear parcel shelf including a still further example of the speaker arrangement.
Figure 30:
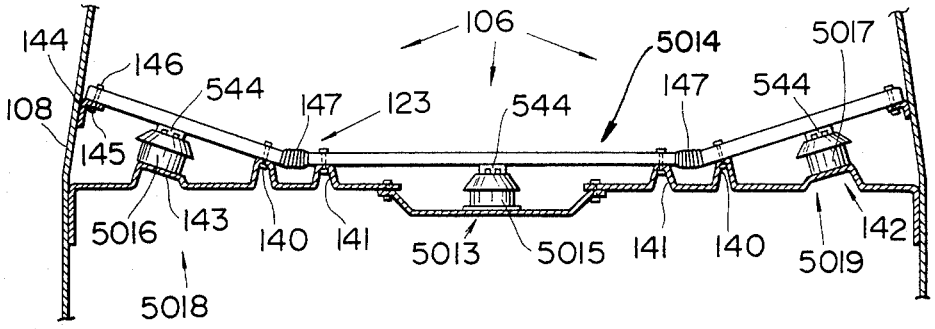
FIG. 30 is a transverse section of the speaker arrangement taken along line 30—30 of FIG. 29.
Figure 31:
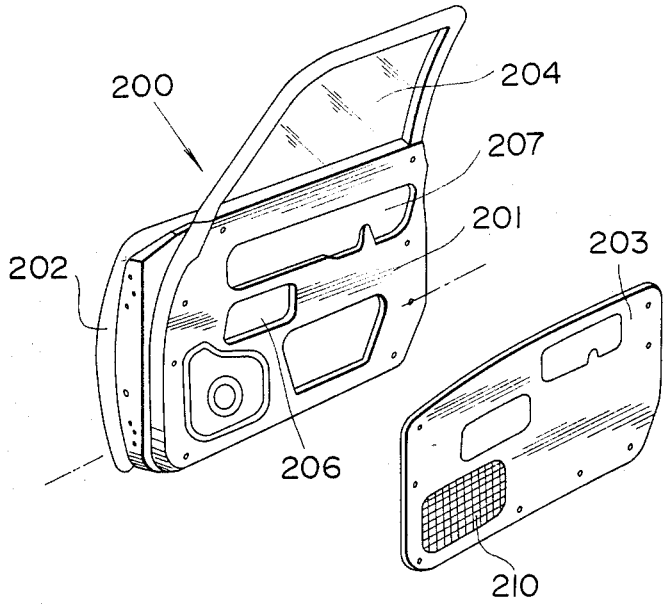
FIG. 31 is an exploded perspective view of a vehicle door assembly which has one example of a panel speaker arrangement of the present invention.
Figure 32:
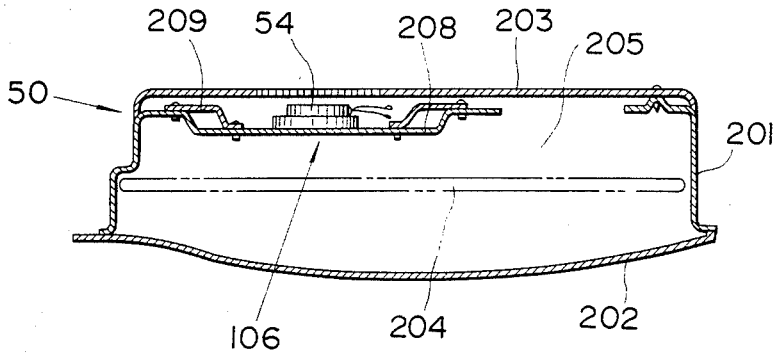
FIG. 32 is a cross-section of the vehicle door assembly of FIG. 31 taken along line 32—32 of FIG. 31.

FIGS. 29 and 30 show a sixth arrangement in which the driver 54 structure similar to that illustrated in FIGS. 8 and 10. The parcel shelf inner panel 103 is secured to the vehicle body inner side panel 108 at both ends thereof and has two pairs of transversally extending ribs 140 and 141. Each pair of ribs 140 and 141 extend in parallel relationship with respect to each other. Near both ends, the parcel shelf inner panel 103 is further formed with driver bases 142 having a sloped surface 143 and with a central opening for inserting a low-frequency driver 5013 of a panel speaker 5014 for creating relatively low-frequency sounds. The driver 5013 is attached to the parcel shelf inner panel 103 via the driver housing 5015. On the other hand, the drivers 5016 and 5017 for the relatively high-frequency panel speakers 5018 and 5019 are secured to the driver bases 142.

Each of the drivers 5013, 5016 and 5017 is connected to the rear parcel shelf 100 via an elastic member 544. Both ends of the rear parcel shelf 100 are secured to the vehicle body inner side panel 108 via brackets 144, bolts 145 and nuts 146. The rear parcel shelf 100 is further secured to the ribs 140 and 141 with screws 105 and is provided with bellows-shaped expandable sections 147 at the supporting sections 123. The expandable section 147 serves to absorb expansion and contraction of the rear parcel shelf 100 and to prevent transmission of oscillation between adjacent oscillating sections 106. Likewise, the elastic members 544 aid to transmit oscillation produced by the driver to the exact centers of the oscillating sections 106 even when the parcel shelf 100, acting as a sound-producing medium, is offset due to expansion thereof.

It should be appreciated that, in the arrangement shown, the panel speakers 5018 and 5019 are respectively adapted to work as left and right speaker and the panel speaker 5014 as a bass speaker, which together constitute a stereo system.

FIGS. 31 to 36 show variations of the panel speaker arrangements in which the panel speakers are installed in a vehicle door assembly. The vehicle door assembly 200 generally comprises a door inner panel 201, a door outer panel 202, a door trim 203 and a door windshield 204. The windshield 204 is associated with the window retractor (not shown) so that it may move up and down along guide rails disposed within a space 205 defined between the door inner and outer panels 201 and 202. An arm rest may be included on the outer surface of the door trim. The door inner panel 201 is formed with openings 206 and 207 respectively receiving window retractor handle and the inside handle escutcheon of the door lock mechanism. The door inner panel 201 is further formed with a support 208 at the portion which does not interfere with the window or the door lock mechanism.

The driver 54 of the panel speaker 50 is fixed onto the door inner panel 201 at the central portion of the support 208. A reinforcement channel 209 is secured around the circumference of the support in order to prevent transmission of extraneous vibrations from the support which thus serves as oscillating section 106 of the door inner panel.

The door trim 203 is formed with an opening 210 covered with polus cloth 211 for permitting the audio sound created by the panel speaker 50 to pass therethrough.

Figure 33:
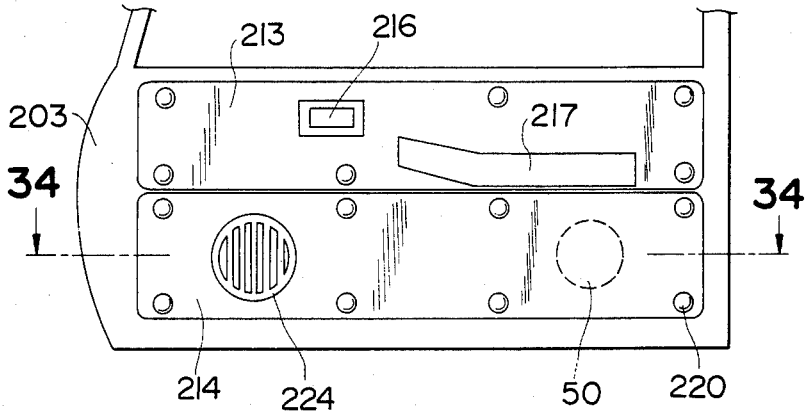
FIG. 33 is a side elevation of the vehicle door assembly having another example of the speaker arrangement.
Figure 34:
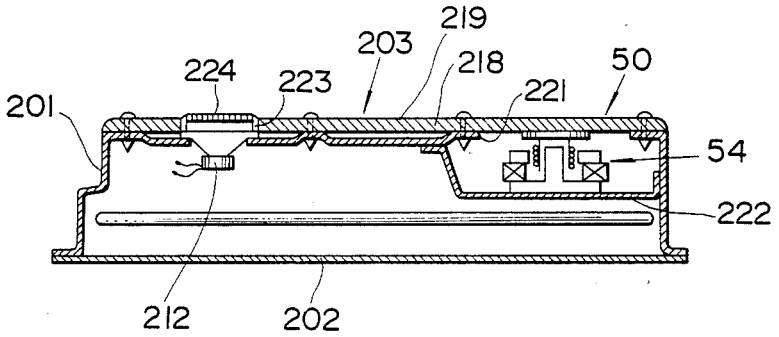
FIG. 34 is a cross-section of the speaker arrangement taken along line 34—34 of FIG. 33.

FIGS. 33 and 34 illustrate another arrangement of the panel speaker system, in which the panel speaker 50 is constituted by the driver 54 and the door trim 203. On the other hand, the embodiment shown further includes a cone speaker 212 mounted on the door inner panel 201. The drive 54 is of construction substantially similar to that illustrated with reference to FIG. 7. As apparent from FIG. 33, the door trim 203 is separated into upper and lower door trims 213 and 214. The window regulator handle 215, inside handle escutcheon 216 and arm rest 217 are housed by the upper door trim 213. The lower door trim 214 is adapted to produce audio sound and therefore comprises a core 218 such as hardboard and a finishing lining 219. The lower door trim 214 is attached to the door inner panel 201 with a plurality of screws 220. The door inner panel 201 has a cut out 221 for receiving the driver 54. The driver 54 is secured to the driver housing 222 which is secured to the door inner panel 201. The lower door trim 214 is formed with a through opening 223 which is covered with a speaker grille 224 in order to protect the cone speaker 212.

Figure 35:
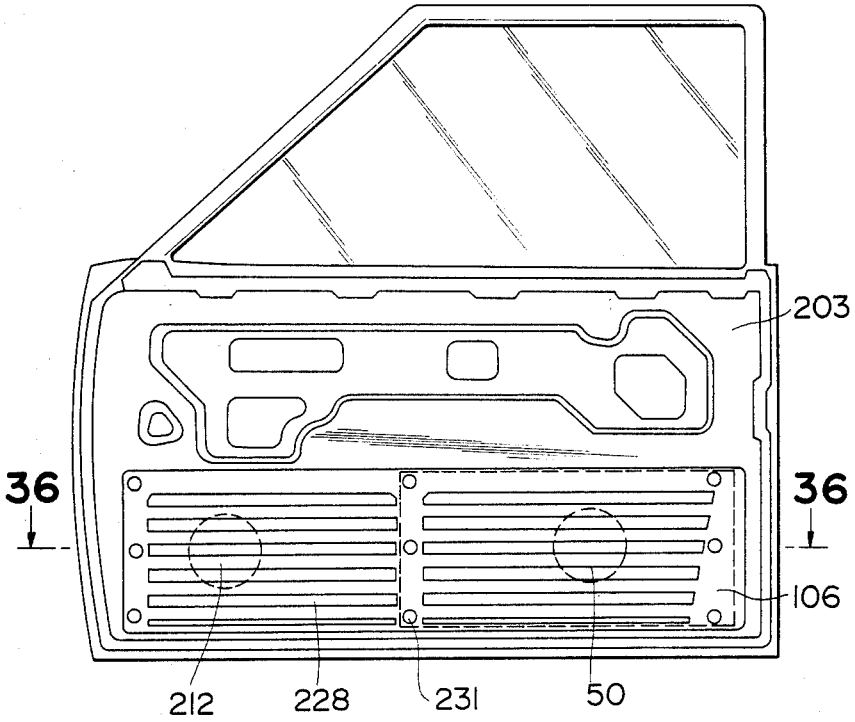
FIG. 35 is a side elevation of the vehicle door assembly having a further example of the speaker arrangement.
Figure 36:
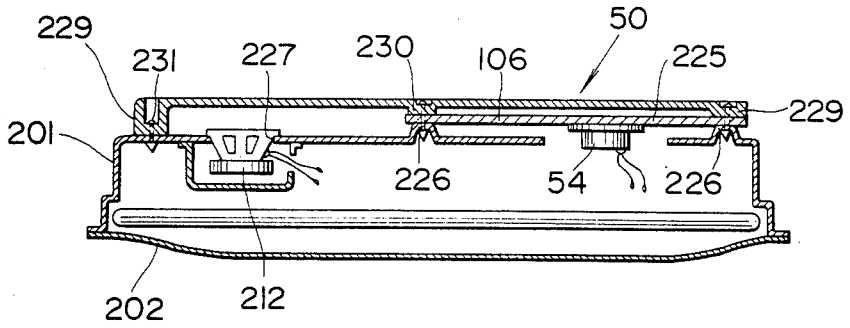
FIG. 36 is a cross-section of the speaker arrangement taken along line 36—36 of FIG. 35.

FIGS. 35 and 36 show the third arrangement of the speaker system. In this embodiment, the panel speaker 50 comprises a panel 225 adapted to produce audio sound vibrations and a driver 54 attached to the panel 225. The panel 225 is secured to ribs 226 of the door inner panel 201 which define the limits of the oscillating section 106. The door inner panel 201 is formed with an opening 227 to receive the driver 54 and an opening for receiving a cone speaker 212. A speaker grille 228 overs the entire area of the speaker system so that the speakers 50 and 212 are not exposed to the vehicle compartment. The speaker grille 228 has edge portions 229 extending toward the door inner panel 201 and a central rib 230, through which the speaker grille 228 is secured to the door inner panel 201 with the screws 231 in spaced apart position with respect to the door inner panel.

Figure 37:
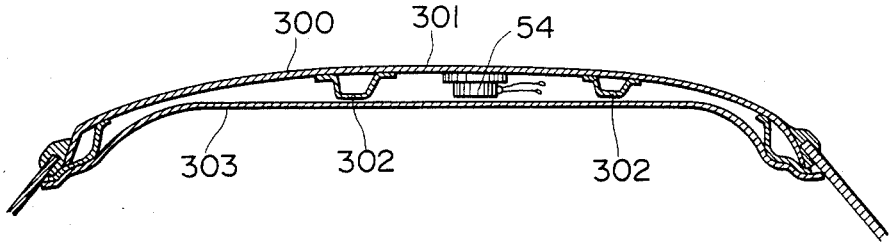
FIG. 37 is a cross-section of a roof structure of the vehicle, in which is provided the panel speaker according to the present invention.

Referring to FIG. 37, there is illustrated an arrangement of the speaker system having the panel speaker on the vehicle roof. The driver 54 is attached to a roof panel 300 to drive the latter in accordance with audio signal fed from the vehicle audio system. The driver 54 is secured to the oscillating section 301 of the roof panel 300 defined by a pair of roof bars 302 serving as reinforcement members for the roof. The panel speaker 50 is covered with a head lining 303 stretched across the roof panel to cover the inside of the roof panel.

As apparent from this description, the embodiment shown uses the roof panel 300 as the sound-producing medium for creating audio sound.

It should be noted that, although the invention has been described in detail with reference to the accompanying drawings of specific embodiments of the present invention, the invention can be embodied otherwise in various constructions and arrangement. Therefore, the invention should not be understood as to specify the constructions and arrangements shown in the drawings. For example, the panel speaker of the present invention can be applied to the instrument panel and other suitable places in the vehicle compartment. Also, the number of the panel speakers to be facilitated in the vehicle compartment is not to be limited to the illustrated embodiments. Therefore, the invention should be understood to include any modifications without departing from the principle of the invention.

What is claimed is:

1. A speaker for an automotive vehicle having an audio system comprising:

a vehicle panel which forms a part of a vehicle body and which is sufficiently flexible to oscillate at an audio frequency, said vehicle panel comprising at least a section adapted to oscillate for producing an audio sound, a housing fixed to said section, and a driving unit resiliently suspended within said housing, associated with said audio system for receiving an audio signal produced by said audio system, and fixed to said section of said vehicle panel separately from said housing to drive said section for oscillation at an audio frequency for producing the audio sound, said driving unit comprising a support element secured to said vehicle panel, a coil wrapped around said support element, and a driver assembly having a permanent magnet positioned adjacent said coil for causing oscillations of said support element, whereby said vehicle panel forms part of said vehicle body and also functions as a diaphragm member of the speaker for producing the audio sound.

2. A speaker as recited in claim 1 wherein said support element is rigidly fixed to said section.

3. A speaker as recited in claim 1 further comprising an elastic element positioned between said support element and said section.

4. A speaker as recited in claim 3 wherein said elastic element is secured to at least one of said support element and said section.

5. A speaker as recited in claim 1 wherein said driver unit further comprises stopper elements for limiting the oscillation of said support element.

6. An automotive speaker for an automotive audio system producing an audible frequency of an audio system, comprising:

a vehicle panel having a section oscillable at an audio frequency and forming part of a vehicle body, said section of said vehicle panel being adapted to serve as a diaphragm of the speaker;

a housing fixed to said section of said vehicle panel;

a driver unit resiliently suspended within said housing and adapted to drive said vehicle panel section at an audio frequency according to the audio signal from said audio system, said driver unit comprising a support element, a coil wrapped around said support element, a driver assembly having a permanent magnet suspendedly positioned adjacent said coil for causing mutual oscillations of said support element and driver assembly, a cone element connected to said support element for oscillating with said support element and means for coupling oscillations of said driver assembly to said section.

7. A speaker for an automotive audio system which produces an audio signal, comprising:

a vehicle panel facing a vehicle compartment and having a section adapted for oscillation at an audio frequency to produce an audible sound;

a driver unit housing secured to said section of said vehicle panel; and a driver unit received in said housing and suspended therein, said driver unit adapted to drive said section of said vehicle panel for transmitting an audible frequency of oscillation to produce an audible sound according to the audio signal fed from said audio system, said drive unit comprising a first support element, a first coil wrapped around said first support element, a first driver assembly having a permanent magnet and positioned adjacent said first coil for causing oscillations of said first support element, a cone element connected to said first support element for oscillating with said first support element, a second support element, a second coil wrapped around said second support element, a second driver assembly resiliently supported from said housing having a permanent magnet and positioned adjacent said second coil for causing oscillations of said second support element and means for connecting said second support element to said section of said panel.

8. A speaker as recited in claim 1, 6 or 7 wherein said vehicle panel is substantially planar.

9. A speaker as recited in claim 1, 6 or 7 wherein said vehicle panel is a rear parcel shelf of said vehicle.

10. A speaker as recited in claim 1, 6 or 7 wherein a plurality of speakers are provided, each having a respective section and respective driving unit and wherein each driving unit is connected to the same audio system.

11. A speaker as recited in claim 10 wherein at least two speakers are provided wherein the section of each speaker comprises different portions of the rear parcel shelf of said vehicle.

12. A speaker as recited in claim 11 wherein said section of said rear parcel shelf associated with each speaker is isolated from one another.

13. A speaker as recited in claim 1, 6 or 7 further comprising a separate cone-type speaker connected to said vehicle audio system.

14. A speaker as set forth in claim 1, wherein said section for oscillation is made of a different material than that of the remainder of said panel.

15. A speaker as recited in claim 1, 6, 7 or 14 comprising a grille element positioned to cover said section on the side of said section opposite said driving unit.

16. A speaker as set forth in claim 6 or 7, wherein said vehicle panel has a section adapted for oscillation which is made of a material different from that of the remainder of said panel.

17. A speaker as set forth in claim 16, wherein said vehicle panel is a rear parcel shelf of the vehicle.

18. A speaker for an automotive vehicle having an audio system comprising:

a vehicle panel which forms a part of a vehicle body and which is sufficiently flexible to oscillate at an audio frequency, said vehicle panel comprising at least a section adapted to oscillate for producing an audio sound, a housing fixed to said section, a resilient plate mounted on and within said housing, and a driving unit mounted on said plate to be resiliently suspended within said housing, associated with said audio system for receiving an audio signal produced by said audio system, and fixed to said section of said vehicle panel separately from said housing to drive said section for oscillation at an audio frequency for producing the audio sound, whereby said vehicle panel forms part of said vehicle body and also functions as a diaphragm member of the speaker for producing the audio sound.

* * * * *